United States Patent [19]

Muck

[11] 4,359,007

[45] Nov. 16, 1982

[54] LOOPER

[75] Inventor: Siegfried Muck, Bayern, Fed. Rep. of Germany

[73] Assignee: Kemptener Maschinenfabrik GmbH, Kempten, Fed. Rep. of Germany

[21] Appl. No.: 120,117

[22] Filed: Feb. 11, 1980

[30] Foreign Application Priority Data

Feb. 10, 1979 [DE] Fed. Rep. of Germany ..... 2905107

[51] Int. Cl.[3] ..... D05B 7/00

[52] U.S. Cl. ..... 112/25; 112/165

[58] Field of Search ..... 112/25, 27, 163, 262.1, 112/269.1, 165

[56] References Cited

U.S. PATENT DOCUMENTS

| | | | |
|---|---|---|---|
| 2,973,730 | 3/1961 | Schweda et al. | 112/165 X |
| 3,120,203 | 2/1964 | Müller | 112/27 |
| 4,011,765 | 3/1977 | Tippmann | 74/193 |
| 4,143,609 | 3/1979 | Matthews | 112/25 X |

FOREIGN PATENT DOCUMENTS

| | | | |
|---|---|---|---|
| 2725826 | 12/1977 | Fed. Rep. of Germany | 112/25 |
| 1016483 | 1/1966 | United Kingdom | 112/25 |
| 1506575 | 4/1978 | United Kingdom | 112/25 |

*Primary Examiner*—Wm. Carter Reynolds

*Attorney, Agent, or Firm*—Antonelli, Terry & Wands

[57] ABSTRACT

A looper for connecting a plurality of knitted parts suspended on a needle ring by means of two chain-stitched seams. One of two sewing needles required for producing the chain-stitched seams is displaced laterally above the stitches supported by knitting needles of the needle ring. Both of the sewing needles required for producing the chain-stitched seams enter at least one row of stitches above the stitches supported by the knitting needles of the needle ring.

2 Claims, 7 Drawing Figures

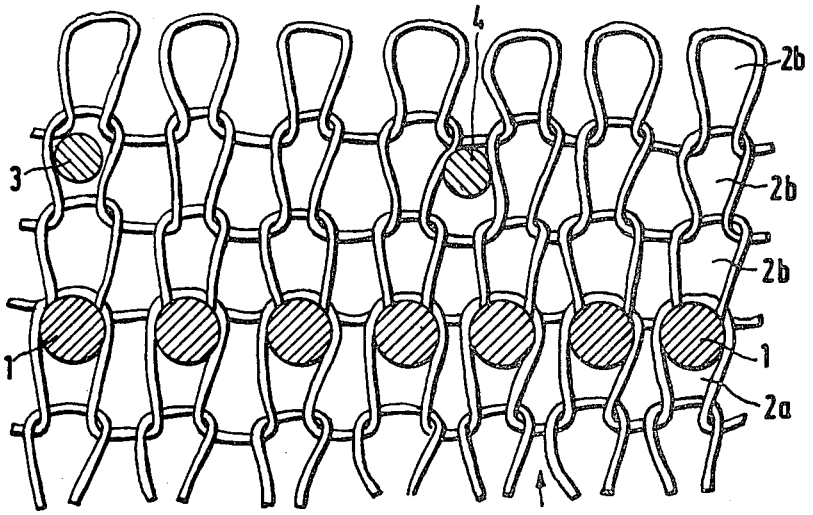
FIG.1
FIG.2
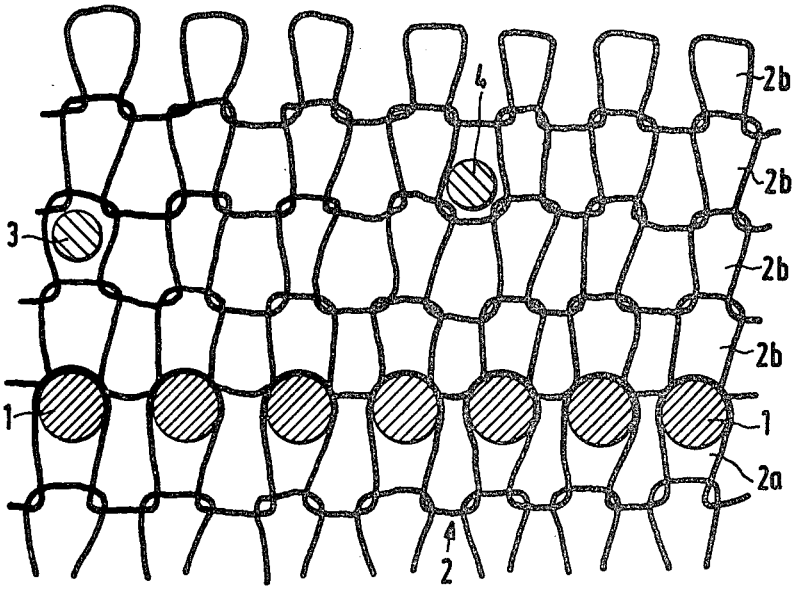

LOOPER

The present invention relates to a knitting construction and, more particularly, to a looper for connecting a plurality of knitted parts or knitted goods suspended on a ring of the looper by means of two chain-stitched seams with one of the two sewing needles required to produce the chain stitched seams passing through the knitted parts being displaced laterally above the stitches supported by the looper points of the looper ring.

The looper of the aforementioned type is proposed in, for example, German Offenlegungsschrift No. 2 725 826, which corresponds to U.S. Pat. No. 4,143,609 wherein one of the sewing needles is disposed in such a manner that it passes through the knitted goods above a plane in which the looper points of the looper ring are located between two adjacent looper points in order to form a chain stitch using a single thread. At the same time, a second sewing needle, likewise using a single thread, forms a second chain stitch while entering the loops in the mesh of the knitted goods suspended on the looper points.

In the above-noted proposed looper construction, it is possible for a plurality of stitches to be located between two adjacent sewing needles when there is a blind contact between the knitted goods. Since each of the sewing needles are capable of fitting into the loop of only one stitch, when the sewing needles enter the material, defective stitches occur more often and result in runs in the material. In constructing such a looper and considering the types of connections, it is important that not all the stitches be included by the chain stitches which link the goods; therefore, an overedging device or head is provided whose number of stitches depends on the looper in order to provide one or more additional chain stitches in the manner of an overedge seam. These additional chain stitches overlap the chain stitches which connect the goods and thus increase protection against runs. A disadvantage of such a procedure resides in the fact that the coarse spacing of the overedge seam requires working with relatively thick threads so that the edge of the cloth can in fact be closed to some extent in order to produce a neat appearance. However, the seam produced in this manner is quite bulky and causes irritation when the goods are worn.

The aim underlying the present invention essentially resides in providing a looper which ensures, with a high degree of certainty, that all the stitches in the knitted goods will be traversed by the sewing needles.

In accordance with advantageous features of the present invention, a looper is provided to connect a plurality of knitted parts suspended on the looper ring by means of two chain-stitched seams whereby one of the two sewing needles required for producing the chain-stitched seams passes through the knitted parts is above the stitches supported by the looper points of the looper ring and is displaced laterally with respect to said looper points with both of the sewing needles entering at least one row of stitches above the row of stitches suspended from the looper points of the looper ring.

By virtue of the features of the present invention, the sewing needles do not merely enter one area of the knitted goods, in which the stitches are markedly distorted by the blind forcing of knitted goods onto the knitting needles, but rather the sewing needles enter an area located above the distorted area in which the knitted goods have to a great extent returned to normal.

Additionally, it is also possible with the looper of the present invention to employ looper points which do not have grooves thereby resulting in a construction which is less expensive to manufacture than the presently proposed loopers. Moreover, it is also unnecessary to adjust the feed of the looper ring precisely to match the spacing of the sewing needles. Thus, it is possible to insert the sewing needles several times into each loop thereby increasing the degree of certainty that each stitch will be caught.

Since it is always necessary when knitted goods are brought into blind contact and then looped together in the manner described hereinabove to cut the edge a uniform distance from the chain stitches connecting the goods and then to use an overedge stitch to cover up the edge of the goods in order to give the material a pleasing neat appearance, in accordance with further features of the present invention, an overedging head is provided whose speed can be smoothly adjusted. By virtue of the provision of the overedging head it is possible to change the number of stitches in the overedge seam relative to the number of stitches in the loop seam thereby making it possible to expand or compress the spacing of the chain stitch.

In accordance with a further feature of the present invention, one of the sewing needles is displaced heightwise by at least one row of stitches relative to the other thereby further ensuring that the one sewing needle enters a row of stitches which is not distorted.

According to the present invention, the stitches in the overedge seam of the overedging head is independent of the chain stitches linking the goods and the chain stitching connecting the goods is located outside of the overedge seam which surrounds the edge of the knitted goods. Thus, depending upon a particular customer's wishes, it is possible to make the edge of the goods with the overedge stitch in such a way that the edge is neatly finished but does not have a bulky appearance. This neat appearance of the edge results primarily from the fact that the overedging device produces a very high number of stitches relative to the number produced by the looper thereby permitting very thin threads to be processed with a very small space between stitches reliably ensuring that all of the stitches are caught. Moreover, the initially formed chain stitches which connect the goods are not included in the overedge stitch.

Accordingly, it is an object of the present invention to provide a looper which avoids, by simple means, shortcomings and disadvantages encountered in the prior art.

Another object of the present invention resides in providing a looper which is simple in construction and therefore relatively inexpensive to manufacture.

A further object of the present invention resides in providing a looper which ensures, with a high degree of certainty, the traversing of all of the stitches by the sewing needles.

A still further object of the present invention resides in providing a looper which functions reliably in all operating conditions.

These and other objects, features, and advantages of the present invention will become more apparent from the following description when taken in connection with the accompanying drawings which show, for the purposes of illustration only, two embodiments in accordance with the present invention, and wherein:

FIG. 1 is a partially schematic view, on an enlarged scale, of a looper ring of a looper in accordance with the present invention supporting the knitted goods to be looped with the sewing needles being disposed in one plane;

FIG. 2 is a partially schematic view, on an enlarged scale, of another embodiment of a looper of the present invention with the sewing needles being located in two different planes;

Figure 7:
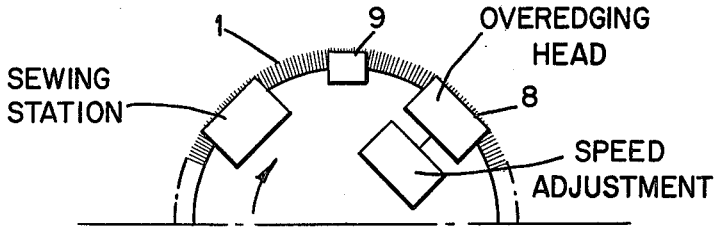
FIG. 7 is a schematic view of a portion of the looper ring showing the overedging head and sewing station.

Referring now to the drawings wherein like reference numerals are used throughout the various views to designate like parts and, more particularly, to FIG. 1, according to this figure, a small section of a looper ring of the looper of the present invention has suspended on looper points 1 thereof a piece of knitted goods generally designated by the reference numeral 2 with the stitches in rows properly arranged in such a manner that there are several additional knitted rows 2*b* above the stitches 2*a* suspended on the looper points 1.

A sewing needle 3 is disposed above one of the looper points 1 in the looper ring at a level of the second row of the additional stitches 2*b* of the knitted goods 2 suspended on the looper points 1 of the looper ring. An additional sewing needle 4 is provided laterally at some distance from the sewing needle 3. The sewing needle 4 is disposed at the same height as the sewing needle 3 but located between two adjacent looper points 1 of the looper ring. By virtue of the arrangement of the sewing needles 3 and 4 and the looper points 1 shown in FIG. 1, two seam 5,6 produced by the sewing needles 3,4 are, as shown in FIG. 4, located one directly above the other.

The arrangement of FIG. 2 differs from the arrangement of FIG. 1 only in that the sewing needle 4, which enters the knitted goods 2 between two adjacent knitting needles 1 of the looper ring is not disposed in the plane of the other sewing needle 3 but is located one row of additional stitches 2*b* above the sewing needle 3. By virtue of the arrangement of the sewing needles 3,4 in the manner illustrated in FIG. 2, it is possible, as shown in FIG. 5, to produce two seams 5,6 which run parallel to one another.

Figure 3:
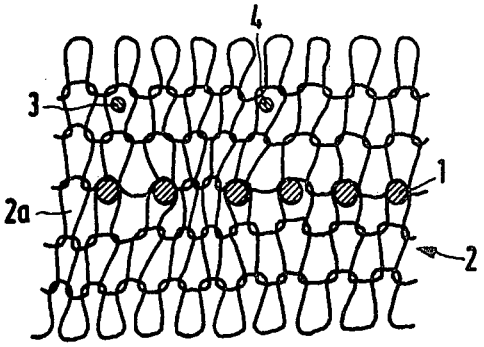
FIG. 3 is a schematic view, on an enlarged scale, of a distorted piece of knitted goods pushed blindly onto the looper points of the looper ring of FIG. 1.

As shown in FIG. 3, when a piece of knitted goods 2 is pushed blindly onto the looper ring of FIG. 1, a pronounced distortion of the knitted goods 2 occurs in an area of the looper points 1, which distortion is caused by the fact that a plurality of stitches 2*a* have come to rest between two adjacent looper points 1. The amount of distortion decreases inversely with the distance between the looper points 1. With the arrangement of sewing needles as shown in FIG. 1, the likelihood that all of the stitches 2*b* will be caught when sewing needles 3 and 4 are inserted into the knitted goods 2 is increased.

Figure 4:
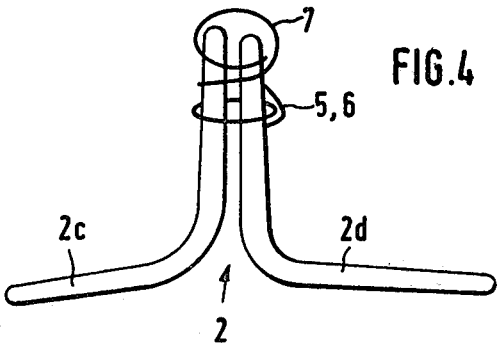
FIG. 4 is an enlarged cross-sectional detailed view of an edge of a piece of knitted goods manufactured on the looper of FIG. 1, provided with an overedge seam.

In the cross-sectional view of the knitted goods shown in FIG. 4, the individual knitted parts 2*c* and 2*d* of the knitted goods 2 are connected by the arrangement of looper points 1 and sewing needles 3,4 shown in FIG. 1. Additionally, a free outer edge of the knitted material 2 is sewn together with an overedge seam 7 which is produced by an overedging head 8, schematically shown in FIG. 7 provided with the looper. The overedging head includes a cutter 9 located ahead of it to cut off the excess fell parallel to the seam 7 with the number of stitches produced by the overedging head being adjustable independently of the number of stitches produced by the sewing needles 3,4.

Figure 5:
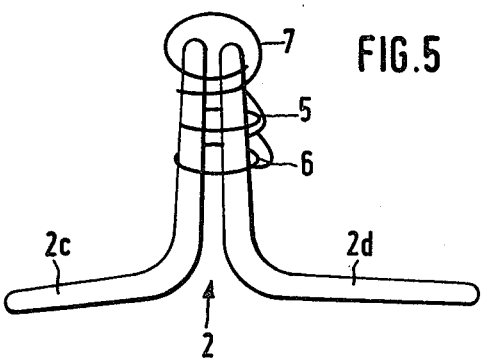
FIG. 5 is an enlarged cross-sectional detailed view of an edge of a piece of knitted goods manufactured on the looper of FIG. 2, provided with an overedge seam.

In the cross-sectional view of FIG. 5, the individual knitted parts 2*c*, 2*d* of a piece of knitted goods are connected by the arrangement of the looper points 1 and sewing needles 3,4 shown in FIG. 2. Also, the free outer edge of the knitted goods 2 is hemmed with an overedge seam 7. The location of the overedge seam 7 is so disposed in all of the arrangements of the present invention, that the seams 5,6 produced by the sewing needles 3,4, i.e. the chain stitches connecting the goods, are located inside the vicinity of the overedge seam 7 with respect to the outer edge of the knitted goods.

Figure 6:
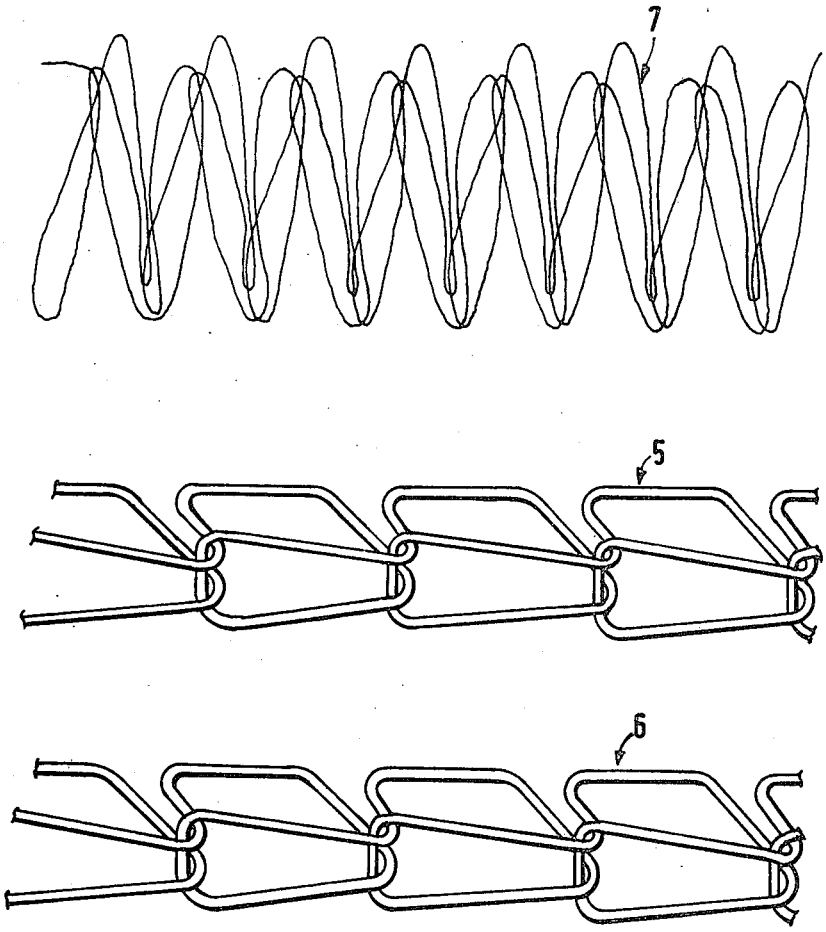
FIG. 6 is an enlarged schematic view of a seam at the edge illustrated in FIG. 5.

As shown in FIG. 6, a piece of knitted goods 2 is provided wherein the number of stitches produced by the overedging head is a multiple of the number of stitches produced by the looper. An overedge seam 7 such as shown in FIG. 6, compressed relative to the seams 5,6, increases protection against runs which could possibly result from failure of the sewing needles 3,4 to engage the stitches 2*b* and results in a considerable improvement in the appearance of the knitted goods 2.

While I have shown and described only two embodiments in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. An arrangement of the sewing needles with respect to the ring of looper points of a looper for connecting a plurality of knitted parts by two chain-stitched seams, said arrangement comprising a ring of a looper having a plurality of looper points for suspending the knitted parts from a row of stitches of the knitted parts, two sewing needles for producing the respective chain-stitched seams, the respective sewing needles being arranged above the looper points of the ring and being adapted to pass through the knitted parts in stitches which are located in a second or higher row of stitches from the row of stitches that are carried by the looper points of the ring, and one of the two sewing needles being displaced laterally with respect to the looper points of the ring, and wherein an overedging head is provided in combination with said arrangement for producing an overedge seam which surrounds an edge of the knitted parts, said overedging head being arranged such that the chain-stitched seams connecting the knitted parts are located further inwardly from the edge of the knitted parts than the overedge seam produced by the overedging head, and the speed of said overedging head being smoothly adjustable so that the number of stitches in the overedge seam can be adjusted independently of the number of stitches in the chain-stitched seams produced by sewing needles.

2. A looper according to claim 1 wherein one of the two sewing needles is disposed in a plane above the other sewing needle by at least one row of stitches.

* * * * *